US008157507B1

(12) United States Patent
Coffin et al.

(10) Patent No.: US 8,157,507 B1
(45) Date of Patent: Apr. 17, 2012

(54) DAMPED STATOR ASSEMBLY

(75) Inventors: Metthew T Coffin, Palm Beach Gardens, FL (US); Louis M Cardoso, III, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 356 days.

(21) Appl. No.: 12/689,488

(22) Filed: Jan. 19, 2010

(51) Int. Cl.
*F01D 9/04* (2006.01)
*F01D 25/04* (2006.01)

(52) U.S. Cl. ..... 415/119; 415/209.4; 415/210.1

(58) Field of Classification Search ..... 415/119, 415/189–191, 208.1, 208.2, 209.2, 209.3, 415/209.4, 210.1
See application file for complete search history.

(56) References Cited

U.S. PATENT DOCUMENTS

| | | | | |
|---|---|---|---|---|
| 3,778,184 | A * | 12/1973 | Wood | 415/209.4 |
| 4,249,859 | A * | 2/1981 | Benyi et al. | 415/209.4 |
| 6,296,442 | B1 * | 10/2001 | Tran | 415/189 |
| 6,409,472 | B1 * | 6/2002 | McMahon et al. | 415/189 |
| 7,291,946 | B2 * | 11/2007 | Clouse et al. | 415/119 |
| 8,087,881 | B1 * | 1/2012 | Cardoso et al. | 415/119 |

* cited by examiner

*Primary Examiner* — Christopher Verdier
(74) *Attorney, Agent, or Firm* — John Ryznic

(57) ABSTRACT

A stator assembly having an inner shroud and an outer shroud with a plurality of airfoils extending between the shrouds, and a vibration damping horn extending from one of the shrouds and aligned with the airfoil, the vibration damping horn having a higher stiffness than the airfoil, the vibration damping horn extends into a damping chamber formed between the shroud and a seal plate, and the damping chamber is filled with ceramic balls that rub against the vibration damping horn to dissipate vibration energy from the airfoil by friction.

9 Claims, 3 Drawing Sheets

DAMPED STATOR ASSEMBLY

FEDERAL RESEARCH STATEMENT

None.

CROSS-REFERENCE TO RELATED APPLICATIONS

None.

BACKGROUND OF THE INVENTION

1. Field of the Invention

The present invention relates generally to a stator assembly for a turbo-machine, and more specifically to a damped stator assembly.

2. Description of the Related Art Including Information Disclosed Under 37 CFR 1.97 and 1.98

An axial flow compressor in a gas turbine engine includes a row of stator vanes upstream and downstream of a row of rotor blades, the stator vanes functioning to guide the air flow into the rotor blades for increasing the efficiency and diffusing the air to increase static pressure. The stator vanes include an arrangement of airfoils that extend between an outer shroud and an inner shroud that defines the flow path through the stator assembly. The stator assembly is also subject to vibrations and thermal stress from high temperature exposure. For these reasons, prior art stator assemblies are formed as segments with one, two, three or more vanes in each segment. Adjacent stator segments are separated by a relief slit to allow for thermal expansion to allow free vibration of the shrouded segments against frictional damper springs, and thus reducing vibratory stresses and extending the life of the part. However, these relief slits allow for leakage of the fluid through the stator assembly. When the segment includes a single vane, then the leakage flow area is larger.

To provide damping to a segmented stator assembly, damper springs are used on the inner shroud area to provide damping. The stator segments are attached to the engine casing at the outer shroud location while the inner shroud is unsupported in the turbo-machine. The stator vanes can vibrate in several different modes. The relief slits separate adjacent segments and prevent the vibratory modes from causing destructive amplification in adjacent vane segments. This amplification can lead to cracking and catastrophic failure of the gas turbine engine if the crack is not detected in time. The prior art U.S. Pat. No. 7,291,946 B2 issued to Clouse et al. on Nov. 6, 2007 and entitled DAMPER FOR STATOR ASSEMBLY discloses a stator assembly with a damper spring positioned between an inner surface of the inner shroud and an outer surface of a seal. The damper spring rubs against the seal surface to dampen the stator assembly. In the Clouse et al. invention, the stator assembly is formed from many segments with many relief slits therein. A relief slit exists for every vane in this design. Therefore, the leakage flow is relatively high.

Another disadvantage of relief slits is caused by the mass of the shroud supported by an individual vane. This mass tends to reduce the resonant frequency modes of a vane compared to a similar vane with no attached shroud. Higher resonant frequencies are desirable, possibly avoidable potential drivers under operational conditions.

Another disadvantage yet is the high cost in fabricating the relief slits. Because the leakage is undesirable, the relief slits are held to a close tolerance fabrication to minimize the leakage area. To form close tolerance relief slits, wire electrodischarge machining (EDM) is used to cut the slits which is both time consuming and expensive. Also, removal of the re-melted material subsequent to the cutting further increases the cost of fabricating the relief cuts. This operation is difficult and is often done manually. Further increasing the cost still yet is the cost involved with inspecting the features which is difficult since the relief slits tend to be very narrow and often at compound angles relative to the full ring.

BRIEF SUMMARY OF THE INVENTION

The present invention is a stator assembly for use in a compressor, the stator assembly having an plurality of airfoils extending between an outer shroud and an inner shroud, the stator assembly being formed as large segments to reduce the number of relief slits, the airfoils are cast, brazed or machined integrally into the shrouds, the shroud includes a flexible region around the airfoil such that a relatively low impedance connection is made to a vibration damping horn extending from a thin shroud. The shroud is configured to have a higher stiffness in the forward and aft regions in order to prevent circular distortion of the stator assembly. Also, the shroud may be stiffer between airfoils to further isolate vibratory modes and to further enhance dimensional stability.

The vibration damping horn is cast to or is a continuation of a brazed airfoil. The vibration damping horn is stiffer than the airfoil in order to prevent amplification of the vibration. A number of ceramic balls occupy a space in which the vibration damping horn extends into such that the ceramic balls are in contact with the ends of the vibration damping horns to allow for rubbing and produce the damping. The ceramic balls can be coated with a friction coating to minimize rim wear and improve damping properties.

In an additional embodiment, instead of the damper spring to provide damping to the vibration damping horns, a viscous damping fluid or visco-elastic material surrounds the vibration damping horns to absorb the vibration.

In another embodiment of the present invention, the vibrating damping horn can be located on the outer shroud instead of the inner shroud.

DETAILED DESCRIPTION OF THE INVENTION

Figure 1:
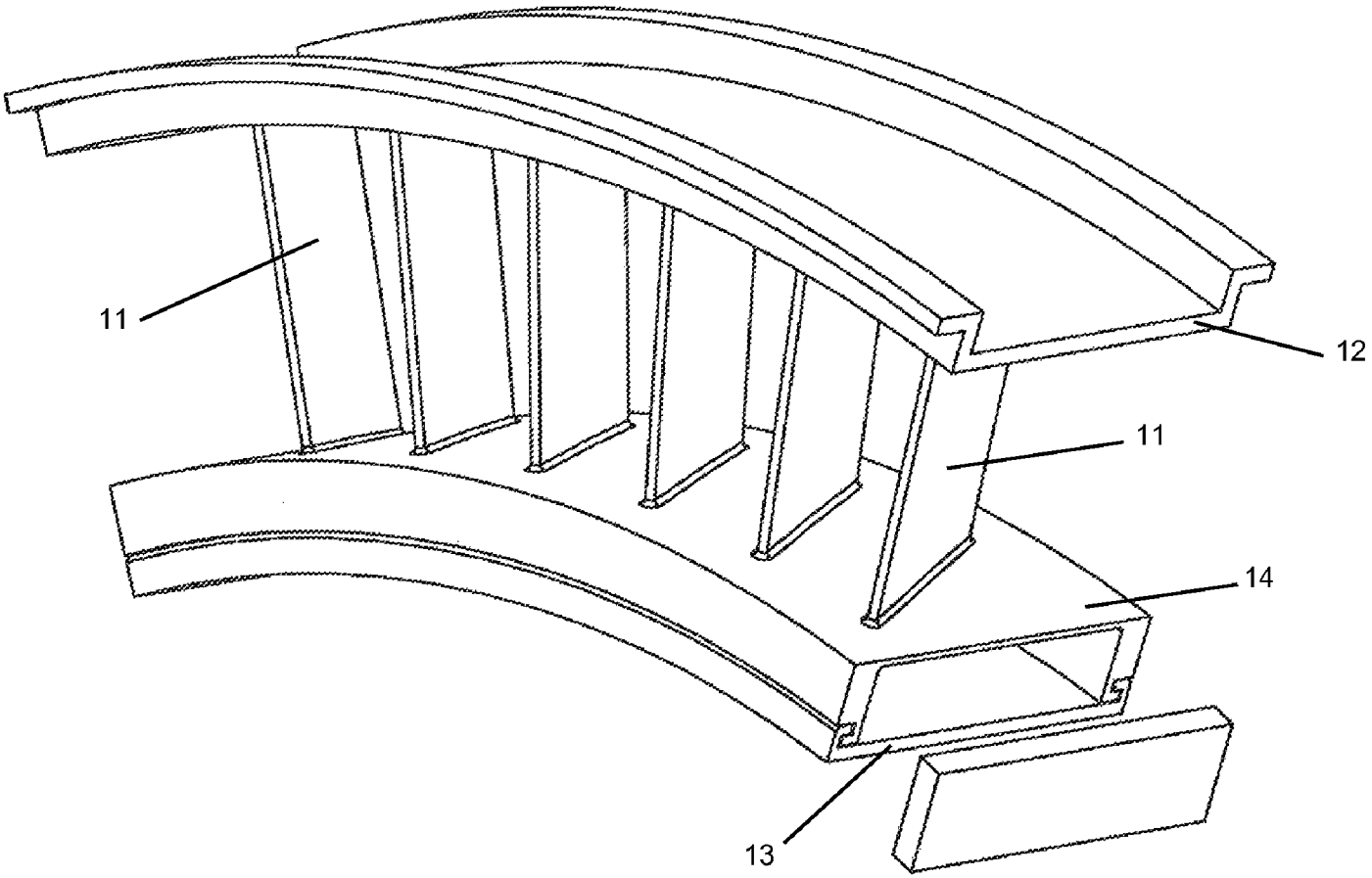
FIG. 1 shows a schematic view from the top of a stator vane segment of the present invention.

A stator assembly segment is shown in FIG. 1 in which a number of airfoils 11 extend between an outer shroud 12 and a thin shroud 14 to form a fluid flow path through the stator assembly. The thin shroud 14 includes legs that extend inward on which a seal 13 is secured, the seal 13 forming an inner shroud for the rotor assembly of the compressor. Extending from the thin shroud 14 is a vibration damping horn 15 (see FIGS. 2-4) that extends into a space formed between the thin shroud 14 and the seal 13 that is filled with a number of ceramic balls 22. As seen in FIG. 1, the segment includes a number of airfoils extending between the shrouds 12 and 14.

Figure 2:
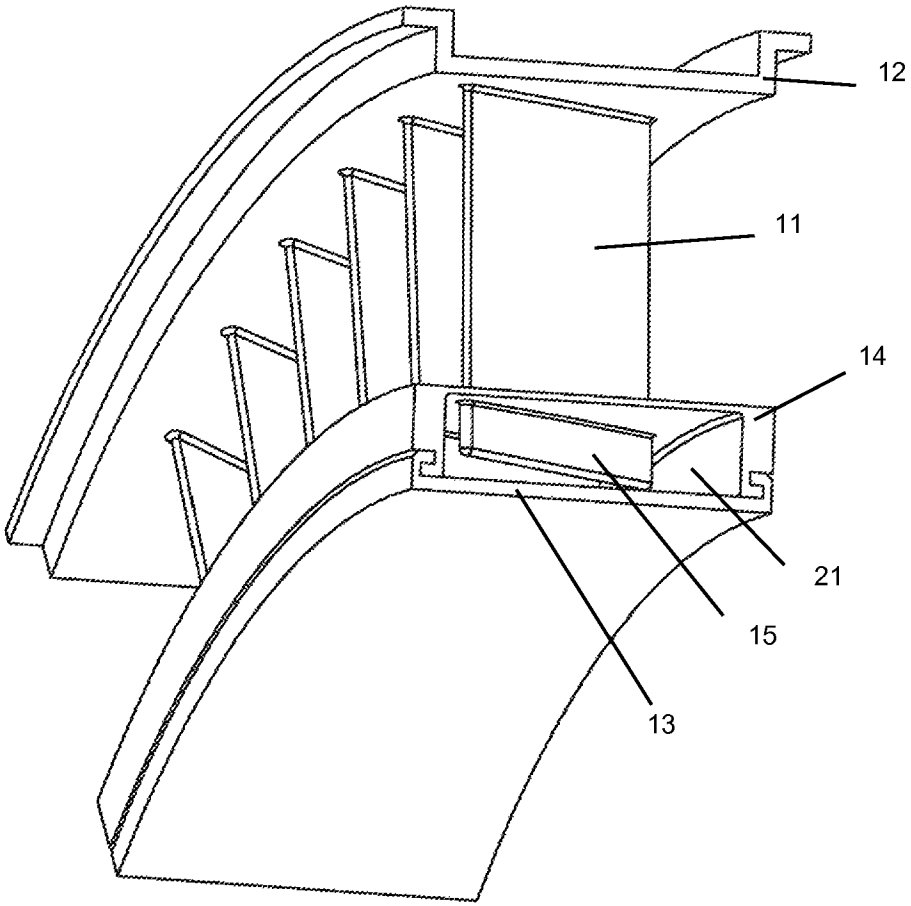
FIG. 2 shows a schematic view from the bottom of a stator vane segment of the present invention.

FIG. 2 shows an isometric view from the bottom of the stator vane segment with the inner thin shroud 14 and the seal 13 forming a space (damping chamber) 21 in which the vibration damping horn 15 extends from the airfoil 11 and into the space or damping chamber 21 that is filled with the ceramic balls 22. A cover plate is used to cover the open ends of the space 15 on both ends of the vane segment.

Figure 3:
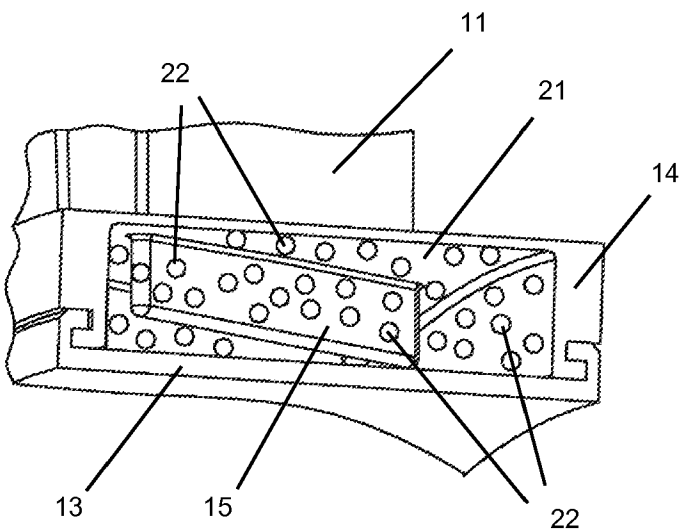
FIG. 3 shows a cross sectional view of the damper space in which the airfoil extends into with a number of ceramic balls.
Figure 4:
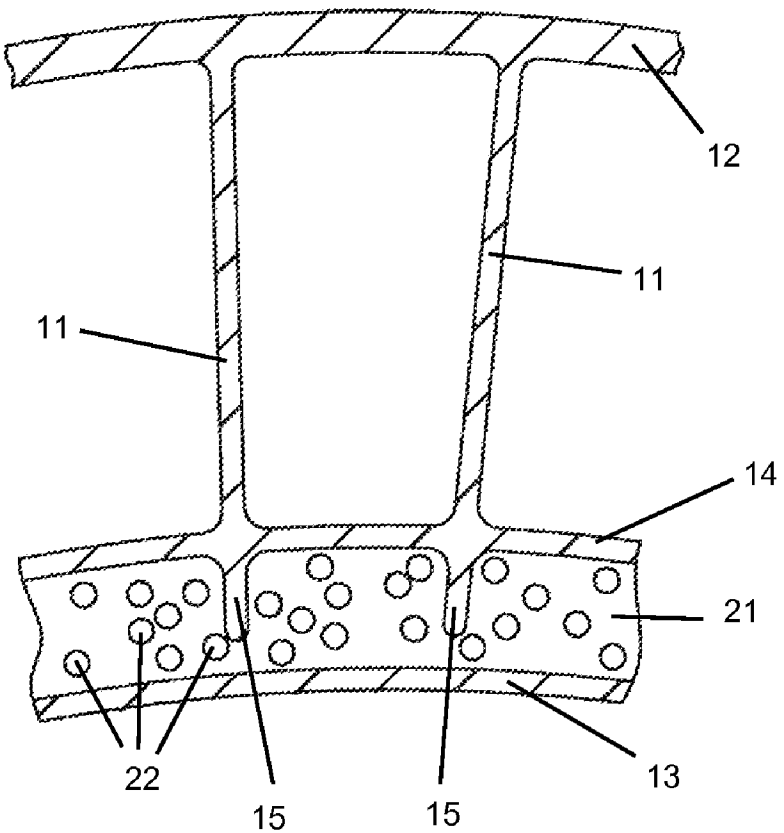
FIG. 4 shows a cross section view of a section of the vane segment with two airfoils extending into the damper space filled with the ceramic balls.

FIG. 3 shows a close-up view of the space 21 formed between the thin inner shroud 14 and the seal 13 with the vibration damping horn 15 extending into the space. The vibration damping horn 15 is an extension of the airfoil and can be integral with the inner and outer shrouds as seen in FIG. 4, or the airfoils with the vibration damping horns 15 can extend through an airfoil shaped slot in the inner shroud 14. The vibration damping horns 15 extend toward the inner surface of the seal 13 but do not contact the seal surface.

FIG. 4 shows a different view of the present invention in which the airfoil 11 includes thin walls that extend between the outer shroud 12 and the thin inner shroud 14. The outer shroud 12 is formed of thicker walls than the airfoil walls 11 and the thin inner shroud 14. The vibration damping horns 15 extend from the airfoil walls 11 in alignment, but are formed with thicker walls than the airfoil walls in order to be stiffer than the airfoil walls 11 as seen in FIG. 3. The space 15 is filled with ceramic balls 22 that can be coated with a friction coating to minimize wear and improve damping properties.

The airfoils in the present invention can be cast, brazed or machined integrally into the shroud. The shroud forms a flexible region around the airfoil such that a relatively low impedance connection is made to a vibration damping horn 15. This shroud is configured to have a higher stiffness in the forward and aft regions to prevent circular distortion of the stator assembly. Also, the shroud may be stiffer between airfoils to further isolate vibratory modes and to further enhance dimensional stability.

The vibration damping horns 15 are cast into or are a continuation of a brazed airfoil but with a thicker wall than the airfoil wall. As the stator assembly vibrates, the vibration damping horns will also vibrate and rub against the ceramic balls 22 to dampen the stator assembly. Because the vibration damping horns 15 are thick in relation to the airfoil walls 11 in order to prevent amplification of the vibratory modes. The vibration damping horn 15 is cast to or is a continuation of a brazed airfoil, and therefore the horn 15 passes the vibratory energy into the damper. The horn 15 is stiffer than the airfoil in order to prevent amplification of the vibration. The ceramic balls rubbing against the vibration damping horns 15 function to dissipate the vibratory energy.

In an additional embodiment, the vibration damping horn 15 extends from the outer shroud section of the stator assembly into a space formed between the outer shroud and a seal enclosing the space so that the damping chamber is formed on the outer shroud instead of the inner shroud as in FIGS. 1-4. The airfoils will extend from the inner shroud and pass through the outer shroud so that the extension that forms the vibrating damping horns will extend into the space that forms the damping chamber. The damping chamber is filled with the ceramic balls to provide the rubbing that dampens the vibrating horns. This additional embodiment is basically the FIG. 1 embodiment but flipped over so that the horns extend radially outward instead of inward.

We claim the following:

1. A stator assembly for a turbo machine comprising:

a stator segment having an inner shroud and an outer shroud;

a plurality of airfoils extending between the inner shroud and the outer shroud;

a vibration damping horn extending from one of the shrouds and in line with an airfoil;

a vibration chamber formed between one of the shrouds and a seal with the vibration damping horn extending into the vibration chamber; and, a plurality of ceramic balls within the vibration chamber in contact with the vibration damping horn.

2. The stator assembly of claim 1, and further comprising: the stator segment is without relief slits formed between adjacent airfoils.

3. The stator assembly of claim 1, and further comprising: the vibration damping horn has a thickness greater than the thickness of the airfoil.

4. The stator assembly of claim 1, and further comprising: the vibration damping horn extends from the inner shroud.

5. The stator assembly of claim 1, and further comprising: the shroud segment includes a plurality of vibration damping horns that extend from the outer shroud.

6. The stator assembly of claim 1, and further comprising: the shroud segment includes a plurality of vibration damping horns that extend from the inner shroud.

7. The stator assembly of claim 1, and further comprising: each of the airfoils includes a vibration damping horn.

8. The stator assembly of claim 1, and further comprising: the stator assembly is used in a compressor to guide flow into rotor blades.

9. The stator assembly of claim 1, and further comprising: the ceramic balls are coated with a friction coating to minimize wear and improve damping properties.

* * * * *